US010477931B2

(12) United States Patent
Tsai

(10) Patent No.: US 10,477,931 B2
(45) Date of Patent: Nov. 19, 2019

(54) SUNSHADE AND METHOD OF PREPARING A CANOPY

(71) Applicant: Yen-Lin Tsai, Taichung (TW)

(72) Inventor: Yen-Lin Tsai, Taichung (TW)

( * ) Notice: Subject to any disclaimer, the term of this patent is extended or adjusted under 35 U.S.C. 154(b) by 335 days.

(21) Appl. No.: 15/274,479

(22) Filed: Sep. 23, 2016

(65) Prior Publication Data

US 2017/0006982 A1 Jan. 12, 2017

Related U.S. Application Data

(63) Continuation-in-part of application No. 14/314,687, filed on Jun. 25, 2014, now Pat. No. 9,717,313.

(51) Int. Cl.
*A45B 25/18* (2006.01)

(52) U.S. Cl.
CPC ..... *A45B 25/18* (2013.01)

(58) Field of Classification Search
USPC ..... 428/90, 88; 135/33.2; 427/389.2
See application file for complete search history.

(56) References Cited

U.S. PATENT DOCUMENTS 5,681,380 A * 10/1997 Nohr ..... B43M 11/08 106/31.36
5,985,773 A 11/1999 Lee
6,589,633 B1 * 7/2003 Ino ..... D06M 11/78 428/195.1
2005/0261408 A1 11/2005 Bauer et al.
2006/0003650 A1 1/2006 Lube

FOREIGN PATENT DOCUMENTS

EP 0410055 A1 1/1991
EP 0807708 A2 11/1997
EP 0913518 A1 5/1999

OTHER PUBLICATIONS

Extended European Search Report issued in corresponding European Application No. 14173986.2 dated Dec. 18, 2014 (6 pages).
Non-Final Office Action issued in related U.S. Appl. No. 14/314,687 dated Dec. 29, 2016 (22 pages).

* cited by examiner

*Primary Examiner* — Lynda Salvatore
(74) *Attorney, Agent, or Firm* — Osha Liang LLP

(57) ABSTRACT

A sunshade includes a support frame and a canopy connected to the support frame and including a light-transmissible fabric sheet of undyed yarns that has opposite inner and outer surfaces, an ink layer formed on one of the inner and outer surfaces of the light-transmissible fabric sheet using dye-sublimation printing techniques, and an opaque enamel coating coated on the other of the inner and outer surfaces of the light-transmissible fabric sheet. The undyed yarns are woven and cross one another to form fabric pores thereamong. The opaque enamel coating fills the fabric pores. A method of preparing a canopy is disclosed.

13 Claims, 6 Drawing Sheets

SUNSHADE AND METHOD OF PREPARING A CANOPY

CROSS-REFERENCE TO RELATED APPLICATION

This application is a continuation-in-part (CIP) of co-pending U.S. patent application Ser. No. 14/314,687, entitled "SUNSHADE AND METHOD OF PREPARING A CANOPY", filed on Jun. 25, 2014.

FIELD

The disclosure relates to a sunshade and a method of preparing a canopy, more particularly to a sunshade with a canopy which includes a light-transmissible fabric sheet of undyed yarns, an ink layer, and an opaque enamel coating.

BACKGROUND

Conventionally, preparation of a canopy for a sunshade with waterproof and sunshade functions includes a step of coating a waterproof coating material on a fabric sheet of dyed yarns.

Formation of the dyed yarns involves immersing undyed yarns into a dyeing bath. During the dyeing process, dye enters an interior of each fiber of the undyed yarns so as to impart an opaque property to the dyed yarns thus formed. The preparation of the canopy requires that the coloring of the fabric sheet and the coating of the waterproof coating material are processed separately, which complicates the process of preparing the canopy. Moreover, the dyeing process results in generation of a considerable amount of dyeing waste water, which is difficult to dispose.

SUMMARY

Therefore, an object of the disclosure is to provide a sunshade that can alleviate at least one of the drawbacks of the prior art.

According to the disclosure, the sunshade includes a support frame and a canopy. The canopy is connected to the support frame and includes a light-transmissible fabric sheet of undyed yarns that has opposite inner and outer surfaces, an ink layer formed on one of the inner and outer surfaces of the light-transmissible fabric sheet using dye-sublimation printing techniques, and an opaque enamel coating coated on the other of the inner and outer surfaces of the light-transmissible fabric sheet. The undyed yarns are woven and cross one another to form fabric pores thereamong. The opaque enamel coating fills the fabric pores.

Another object of the disclosure is to provide a method of preparing a canopy of the sunshade.

According to the disclosure, the method of preparing a canopy includes the following steps:

providing a light-transmissible fabric sheet of undyed yarns, the light-transmissible fabric sheet having opposite inner and outer surfaces, the undyed yarns being woven and crossing one another to form fabric pores thereamong;

printing an ink layer on one of the inner and outer surfaces of the light-transmissible fabric sheet using dye-sublimation printing techniques;

coating an enamel composition on the other of the inner and outer surfaces of the light-transmissible fabric sheet to form an opaque enamel coating on the light-transmissible fabric sheet; and drying the opaque enamel coating.

BRIEF DESCRIPTION OF THE DRAWINGS

Other features and advantages of the disclosure will become apparent in the following detailed, description of the embodiments with reference to the accompanying drawings, of which.

DETAILED DESCRIPTION

Figure 1:
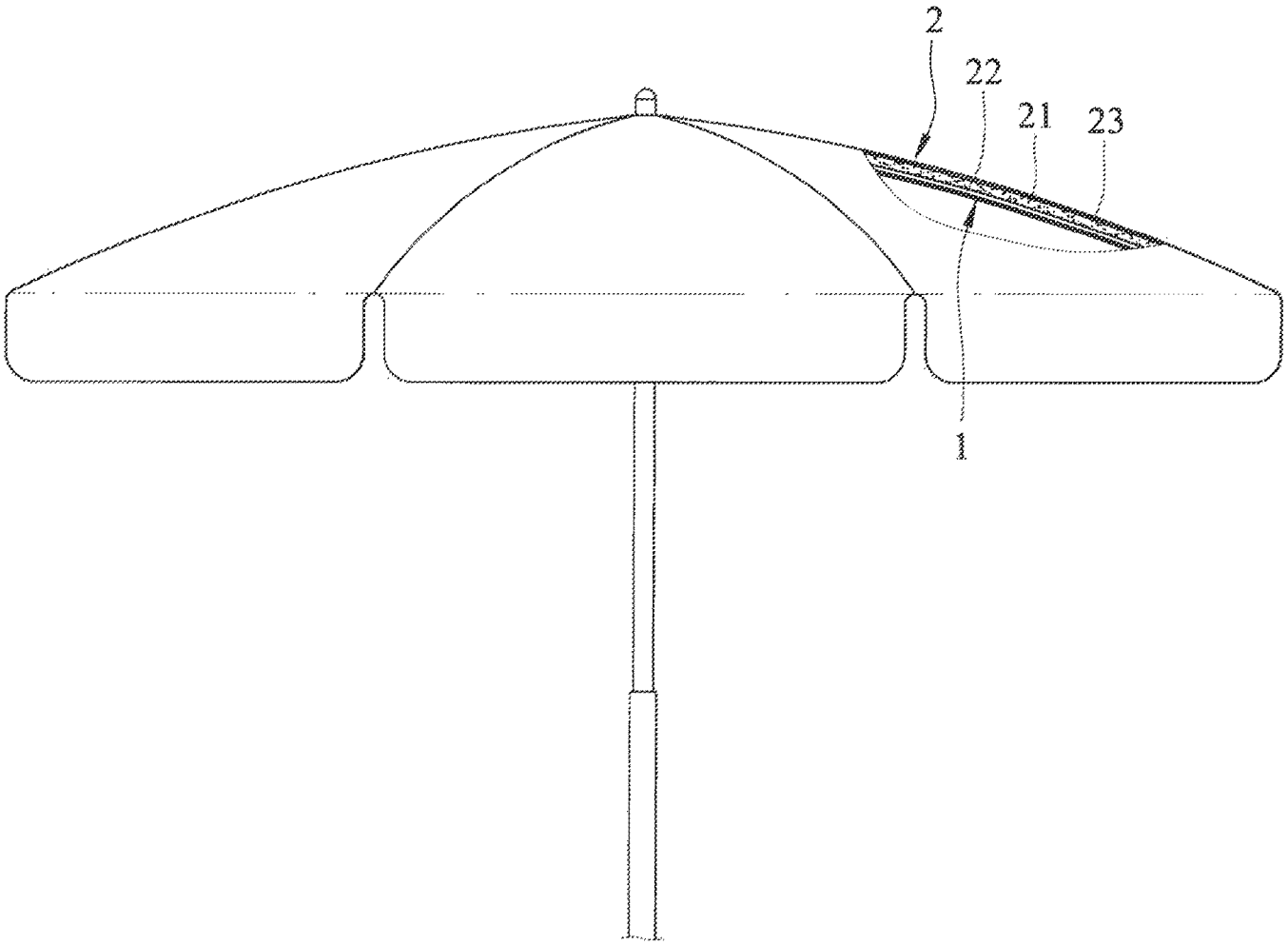
FIG. 1 is a partial sectional view of the first embodiment of a sunshade according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Figure 2:
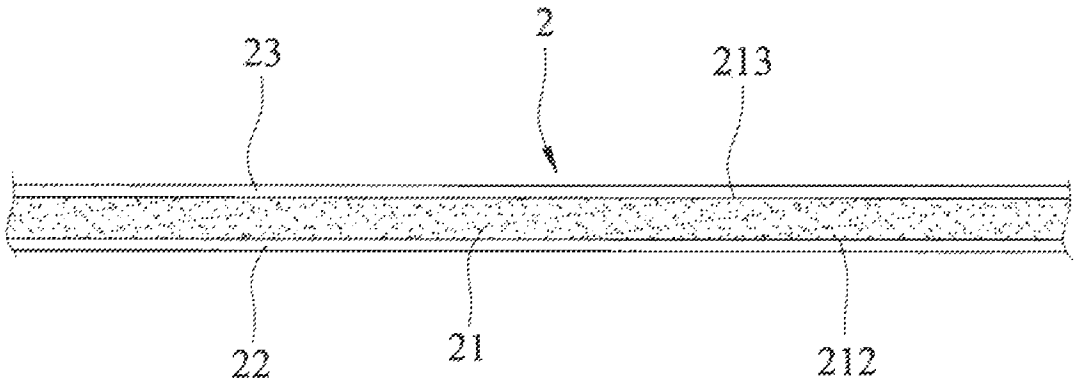
FIG. 2 is a schematic view illustrating a canopy of the first embodiment of the disclosure.
Figure 3:
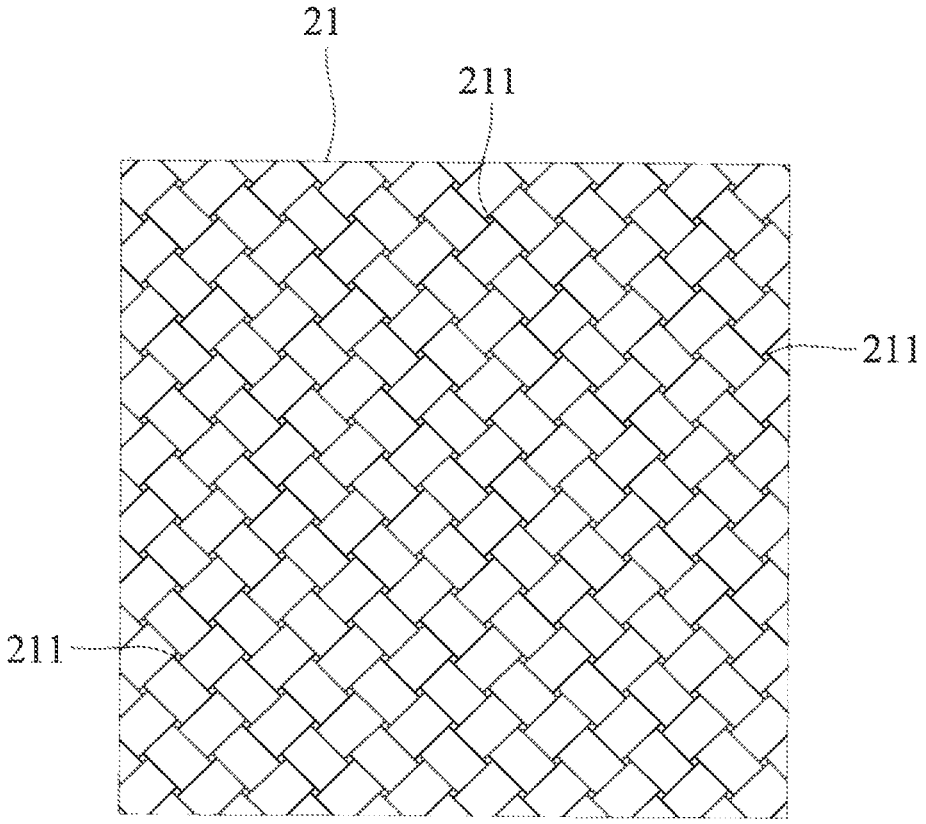
FIG. 3 is an enlarged schematic view of a light-transmissible fabric sheet of the canopy of the first embodiment.

FIGS. 1 to 3 illustrate the first embodiment of a sunshade according to the disclosure.

The sunshade includes a support frame 1 and a canopy 2 connected to the support frame 1. The structure and shape of the support frame 1 are not limited. The sunshade may be portable, such as an umbrella, or fixed, such as a garden sunshade.

The canopy 2 includes a light-transmissible fabric sheet 21 of undyed yarns that has opposite inner and outer surfaces 212, 213, an ink layer 22 formed on one of the inner and outer surfaces 212, 213 of the light-transmissible fabric sheet 21 using dye-sublimation printing techniques, and an opaque enamel coating 23 coated on the other of the inner and outer surfaces 212, 213 of the light-transmissible fabric sheet 21. In this embodiment, the ink layer 22 is formed on the inner surface 212 of the light-transmissible fabric sheet 21, and the opaque enamel coating 23 is coated on the outer surface 213 of the light-transmissible fabric sheet 21.

Preferably, the light-transmissible fabric sheet 21 is a woven fabric. The undyed yarns are woven and cross one another to form fabric pores 211 thereamong. The opaque enamel coating 23 fills the fabric pores 211, and covers sealingly the undyed yarns on the other of the inner and outer surfaces 212, 213 of the light-transmissible fabric sheet 21, so that the surface coated with the opaque enamel coating 2 is waterproof and opaque.

In certain embodiments, the ink layer 22 includes a pigment, and is free of an adhesive resin (e.g., a resin including polyurethane-acrylic polymer).

In certain embodiments, the opaque enamel coating 23 includes a pigment component and an adhesive resin. In certain embodiments, the pigment component may be a color masterbatch. The color masterbatch may be an oil pigment, and may be surface modified to improve dispersion thereof in an aqueous solution. In certain embodiments, the adhesive resin of the opaque enamel coating 23 includes a polyurethane-acrylic polymer. In certain embodiments, the polyurethane-acrylic polymer includes hexamethylene diisocyanate.

In certain embodiments, the opaque enamel coating 23 has a color fastness greater than 500 hours when measured in accordance with AATCC Test Method, or of grade 6 to 7 according to ISO.

In certain embodiments, the undyed yarns are made from a material selected from the group consisting of polyvinyl chloride, polyurethane, aliphatic diisocyanates, and combinations thereof. Aliphatic diisocyanate may be hexamethylene diisocyanate (HDI). In certain embodiments, the undyed yarns are made from HDI.

Figure 4:
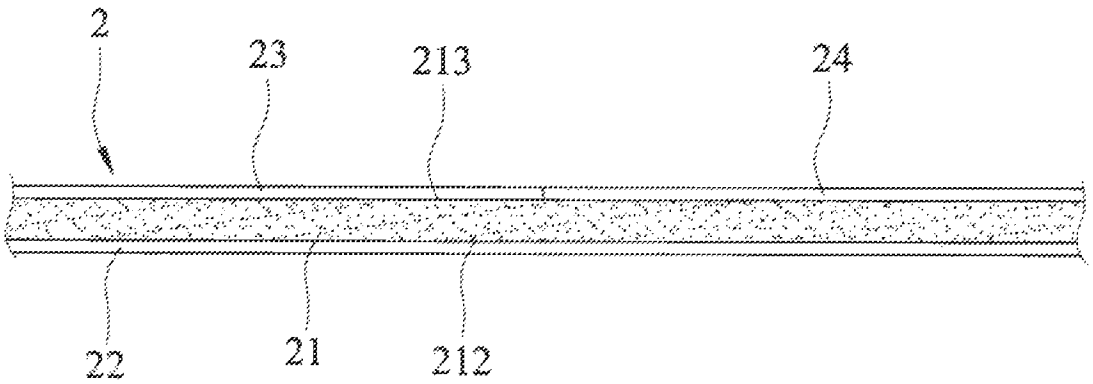
FIG. 4 is a sectional view of the second embodiment of the canopy of the sunshade according to the disclosure.

FIG. 4 illustrates the second embodiment of the sunshade according to the disclosure. The second embodiment differs from the first embodiment in that the outer surface 213 of the light-transmissible fabric sheet 21 is coated with two different opaque enamel coatings 23, 24 at two different regions, respectively. Compositions of the opaque enamel coatings 23, 24 are different, so that the two different regions of the light-transmissible fabric sheet 21 have different colors and/or properties.

Figure 5:
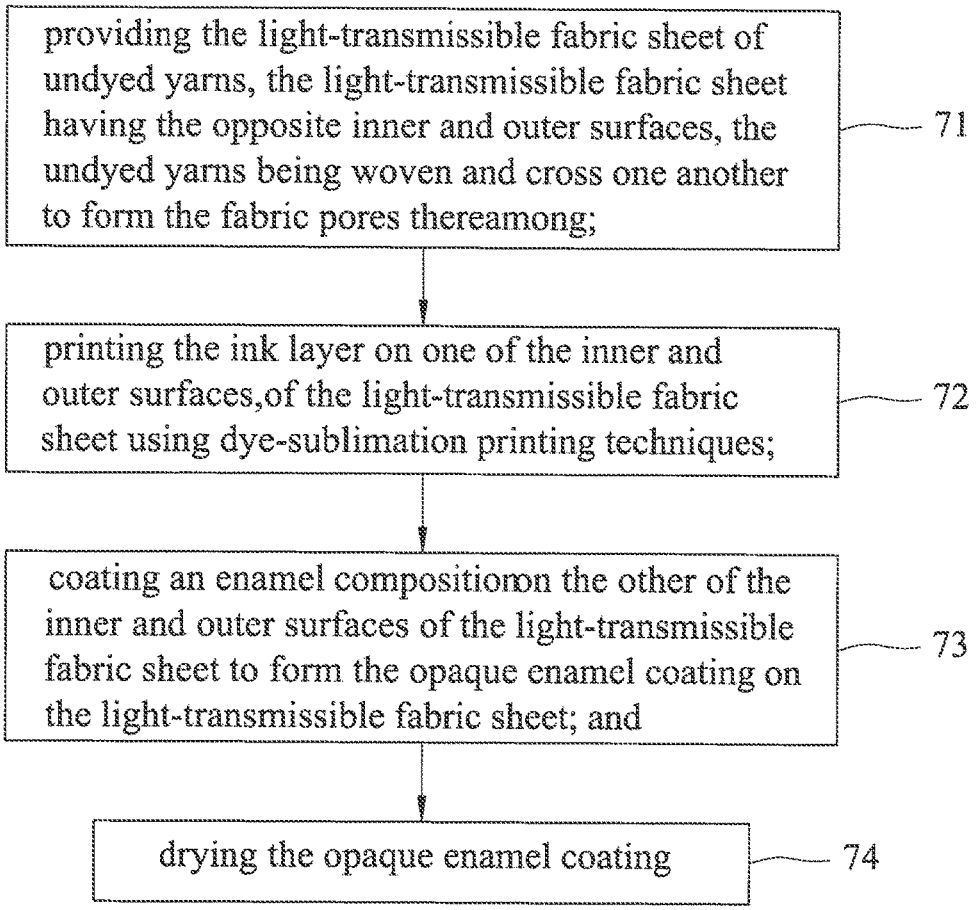
FIG. 5 is a flow chart of a method of preparing the canopy of the disclosure.
Figure 6:
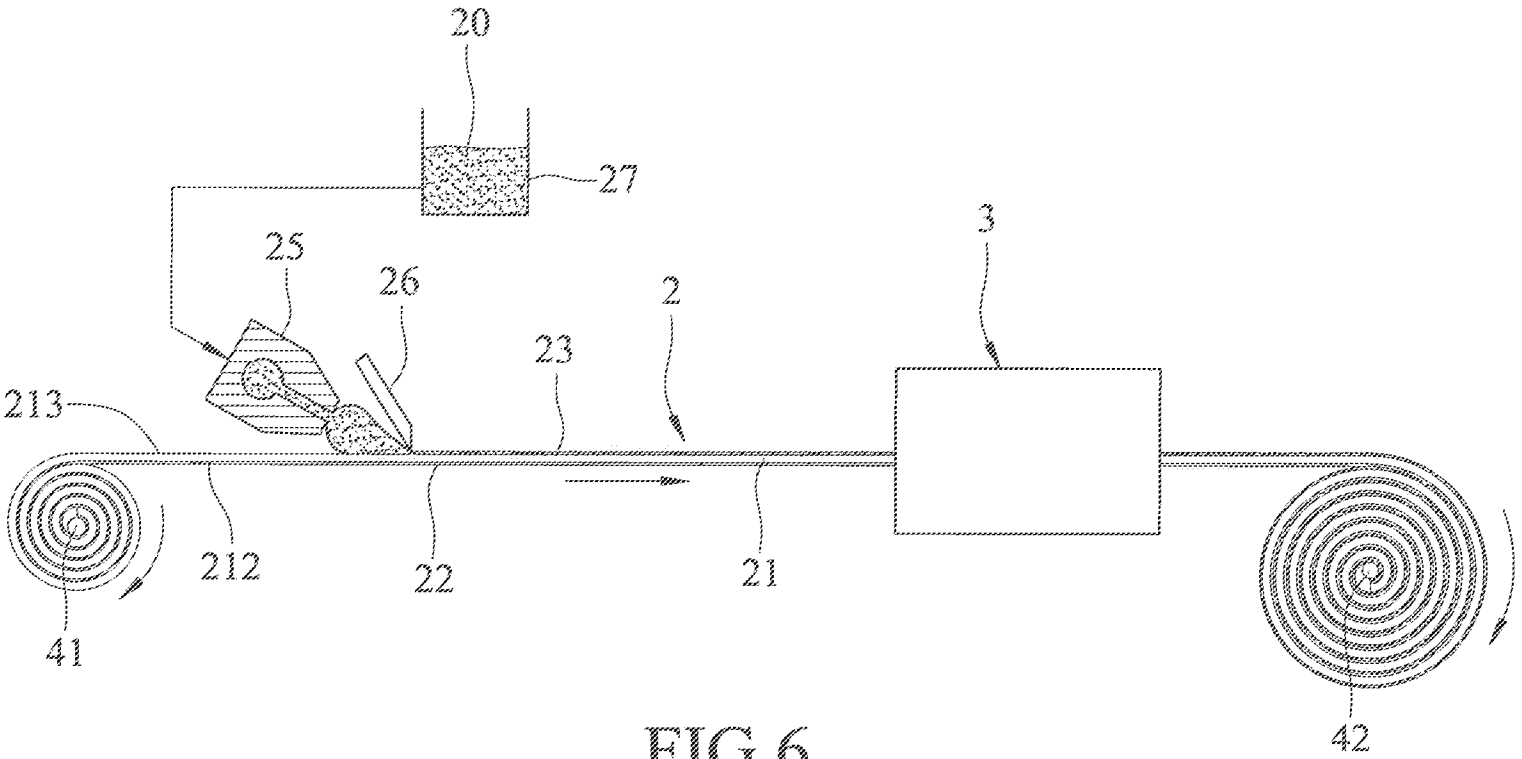
FIG. 6 is a schematic view of a processing system that can be used in the method of preparing the canopy of the disclosure.

FIG. 5 illustrates consecutive steps of a method for preparing the canopy of the sunshade of the first embodiment according to the disclosure. FIG. 6 illustrates a processing system that can be used in the method of the present disclosure.

The method includes the steps of:

step 71: providing the light-transmissible fabric sheet 21 of undyed yarns, the light-transmissible fabric sheet 21 having the opposite inner and outer surfaces 212, 213, the undyed yarns being woven and crossing one another to form the fabric, pores 211 thereamong;

step 72: printing the ink layer 22 on one of the inner and outer surfaces 212, 213 of the light-transmissible fabric sheet 21 using dye-sublimation printing techniques;

step 73: coating an enamel composition 20 (see FIG. 6) on the other of the inner and outer surfaces 212, 213 of the light-transmissible fabric sheet 21 to form the opaque enamel coating 23 on the light-transmissible fabric sheet 21; and step 74: drying the opaque enamel coating 23.

In this embodiment, the ink layer 22 is formed on the inner surface 212 of the light-transmissible fabric sheet 21, and the opaque enamel coating 23 is coated on the outer surface 213 of the light-transmissible fabric sheet 21.

The ink of the ink layer 22 may penetrate into the undyed yarns of the light-transmissible fabric sheet 21 from the inner surface 212 to the outer surface 213. If the ink layer 22 is formed on the inner surface 212 after forming the opaque enamel coating 23 on the outer surface 213, ink penetrating into the outer surface 213 would affect the coloring of the opaque enamel coating 23. Thus, in certain embodiments, the step of coating the enamel composition 20 is conducted after the step of printing the ink layer 22.

As shown in FIGS. 5 and 6, in step 73, a supplying reel 41 is provided for supplying the light-transmissible fabric sheet 21 having the ink layer 22 on the inner surface 212 thereof to go through the subsequent coating and drying operations. The enamel composition 20 is stored in a tank 27. When conducting coating, the enamel composition 20 is guided to the outer surface 213 of the light-transmissible fabric sheet 21 using a die head 25, followed by spreading the enamel composition 20 using a scraper 26 so that the enamel composition 20 is uniformly coated on the outer surface 213 of the light-transmissible fabric sheet 21. In step 74, a dryer 3 is provided for drying the opaque enamel coating 23 on the continuous light-transmissible fabric sheet 21 passing through the scraper 26. A pickup reel 42 is provided for collecting the canopy thus obtained.

In certain embodiments, the enamel composition 20 includes a pigment component, an adhesive resin, and as solvent. The pigment is in an amount ranging from 12 to 17 wt %, the adhesive resin is in an amount ranging from 40 to 60 wt %, and the solvent is in an amount ranging from 20 to 40 wt %. In certain embodiments, the amount of the pigment component is 15 wt %, the amount of the adhesive resin is 50 wt %, and the amount of the solvent is 35 wt %.

The pigment component and the adhesive resin of the enamel composition 20 are the same as those contained in the aforesaid opaque enamel coating 23. Examples of the solvent of the enamel composition 20 are dimethylformamide (DMF) and toluene.

In certain embodiments, the enamel composition 20 further includes a cross-linking agent. The cross-linking agent is in an amount ranging from 1 to 4 wt %.

In certain embodiments, the method of preparing the canopy further includes immersing the light-transmissible fabric sheet 21 coated with the in layer 22 and the opaque enamel coating 23 into a hot water bath before drying the opaque enamel coating 23, followed by immersing the light-transmissible fabric sheet 21 into a cold water bath. The temperature of the not water ranges from 100 to 120° C., and the temperature of the cold water ranges from 30 to 50° C. The treatments described above would improve the color fastness and softness of the canopy 2.

In certain embodiments, drying of the opaque enamel coating 23 is conducted by subjecting the opaque enamel coating 23 on the continuous light-transmissible fabric sheet 21 to a hot air blowing treatment.

To sum up, in this disclosure, the inner and outer surfaces 212, 213 of the light-transmissible fabric sheet 21 are treated with different materials using different procedures, thereby simultaneously providing different functions for the canopy 2. As compared to the method of preparing the aforesaid conventional canopy, both the opaque and waterproof properties are imparted to the light-transmissible fabric sheet 21 in only one single step, i.e., the coating of the opaque enamel coating 23 on the light-transmissible fabric sheet 21, and the light-transmissible fabric sheet 21 of undyed yarns is not required to undergo the dyeing process, thereby eliminating the aforesaid problem of generation of the dyeing waste water. In addition, the method of the present disclosure allows coating of the light-transmissible fabric sheet 21 at different regions thereof with different colors of the opaque enamel coatings 23 so as to permit various designs and features on the light-transmissible fabric sheet 21.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are some grouped together in a single embodiment, figure, or description thereof for the purpose of streamlining the disclosure and aiding in the understanding of various inventive aspects.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A sunshade comprising:

a support frame; and a canopy connected to said support frame and including a light-transmissible fabric sheet of undyed yarns that has opposite inner and outer surfaces, an ink layer directly formed on one of said inner and outer surfaces of said light-transmissible fabric sheet using dye-sublimation printing techniques, and an opaque enamel coating coated on the other of said inner and outer surfaces of said light-transmissible fabric sheet;

wherein said undyed yarns are woven and cross one another to form fabric pores thereamong, said opaque enamel coating filling said fabric pores; and wherein said ink layer includes a pigment and is free of an adhesive resin.

2. The sunshade as claimed in claim 1, wherein said enamel coating includes a pigment component and an adhesive resin.

3. The sunshade as claimed in claim 2, wherein said pigment component is a color masterbatch.

4. The sunshade as claimed in claim 2, wherein said adhesive resin includes a polyurethane-acrylic polymer.

5. The sunshade as claimed in claim 1, wherein said undyed yarns are made from a material selected from the group consisting of polyvinyl chloride, polyurethane, aliphatic diisocyanates, and combinations thereof.

6. The sunshade as claimed in claim 1, wherein said ink layer is formed on said inner surface of said light-transmissible fabric sheet, and said opaque enamel coating is coated on said outer surface of said light-transmissible fabric sheet.

7. A method of preparing a canopy, comprising:

providing a light-transmissible fabric sheet of undyed yarns, the light-transmissible fabric sheet having opposite inner and outer surfaces, the undyed yarns being woven and crossing one another to form fabric pores thereamong;

directly printing an ink layer on one of the inner and outer surfaces of the light-transmissible fabric sheet using dye-sublimation printing techniques, the ink layer including a pigment, and being free of an adhesive resin;

coating an enamel composition on the other of the inner and outer surfaces of the light-transmissible fabric sheet to form an opaque enamel coating on the light-transmissible fabric sheet; and drying the opaque enamel coating.

8. The method of claim 7, wherein the enamel composition includes a pigment component, an adhesive resin, and a solvent, and wherein the pigment component is in an amount ranging from 12 to 17 wt %, the adhesive resin is in an amount ranging from 40 to 60 wt %, and the solvent is in an amount ranging from 20 to 40 wt %.

9. The method of claim 8, wherein the pigment component is a color masterbatch.

10. The method of claim 8, wherein the adhesive resin includes a polyurethane-acrylic polymer.

11. The method of claim 7, further comprising immersing the light-transmissible fabric sheet coated with the ink layer and the opaque enamel coating into a hot water bath before drying the opaque enamel coating, followed by immersing the light-transmissible fabric sheet into a cold water bath, wherein the temperature of the hot water ranges from 100 to 120□, and the temperature of the cold water ranges from 30 to 50□.

12. The method of claim 7, wherein drying of the opaque enamel coating is conducted by subjecting the opaque enamel coating to a hot air blowing treatment.

13. The method of claim 7, wherein the step of coating the enamel composition is conducted after the step of printing the ink layer.

* * * * *